US006656047B1

(12) United States Patent
Tarantino et al.

(10) Patent No.: US 6,656,047 B1
(45) Date of Patent: Dec. 2, 2003

(54) COMPUTER-CONTROLLED GAMING APPARATUS AND METHOD

(75) Inventors: Elia R. Tarantino, Las Vegas, NV (US); Eric J. Maiss, Las Vegas, NV (US)

(73) Assignee: Colepat, LLC, North Las Vegas, NV (US)

( * ) Notice: Subject to any disclaimer, the term of this patent is extended or adjusted under 35 U.S.C. 154(b) by 0 days.

(21) Appl. No.: 09/439,934

(22) Filed: Nov. 12, 1999

Related U.S. Application Data

(63) Continuation-in-part of application No. 09/298,604, filed on Apr. 23, 1999, now abandoned.

(51) Int. Cl.[7] ..... A63F 9/04; A63F 9/24

(52) U.S. Cl. ..... 463/22; 463/20; 463/10; 463/42; 273/146

(58) Field of Search ..... 463/9, 10, 13, 463/16, 17, 20, 22, 29, 40, 41, 42; 273/146, 292, 138.1, 138.2, 268, 269, 274

(56) References Cited

U.S. PATENT DOCUMENTS

| | | | |
|---|---|---|---|
| 2,205,471 | A | 6/1940 | Fagerholm |
| 2,812,182 | A | 11/1957 | Fiorino |
| 2,842,368 | A | 7/1958 | Williams |
| 3,505,646 | A | 4/1970 | Affel, Jr. et al. |
| 3,655,199 | A | 4/1972 | Ohki |
| 3,843,133 | A | 10/1974 | Brown |
| 4,033,588 | A | 7/1977 | Watts |
| 4,066,264 | A | 1/1978 | Rowman |
| 4,093,215 | A | 6/1978 | Ballard |
| 4,126,851 | A | 11/1978 | Okor |
| 4,193,598 | A | 3/1980 | Freese |
| 4,247,106 | A | 1/1981 | Jeffers et al. |
| 4,322,612 | A | 3/1982 | Lange |
| 4,335,809 | A | 6/1982 | Wain |
| 4,339,798 | A | 7/1982 | Hedges et al. |
| 4,372,558 | A | 2/1983 | Shimamoto et al. |
| 4,389,048 | A | 6/1983 | Burgess |

(List continued on next page.)

FOREIGN PATENT DOCUMENTS

| | | |
|---|---|---|
| DE | 2724153 | 8/1978 |
| GB | 2190227 | 11/1987 |
| GB | 2253299 A | 2/1992 |

OTHER PUBLICATIONS

Author unknown, "Autotote Corporation Profile," Autotote, pp. 1–5, Sep., 1993.
Author unknown, "Electronic Yahtzee Instructions," Milton Bradley Company, pp. 1–2, 1995.
Author unknown, "Touch the Technology, The Grand Stand System" Autotote, 27 pgs., 1993.
Author unknown, "www.hasbro.com/yahtzee/original/index.html," Hasbro, 1 pg., 1996.

(List continued on next page.)

*Primary Examiner*—Jessica Harrison
(74) *Attorney, Agent, or Firm*—Weide & Miller, Ltd.

(57) ABSTRACT

An apparatus and a method facilitate single user and tournament play of wagering games on a computer-controlled machine. A player provides control input in order to control the game. The machine simulates the rolling of dice to obtain scoring combinations, and the player makes strategic gaming decisions concerning the holding, releasing and re-rolling of the dice, and the assignment of the resulting dice combinations to scoring categories. A game progresses as a player attempts to fill a plurality of scoring categories in order to achieve a high total score. A player wagers on each simulated roll of the dice, and is paid for winning assignments of combinations to categories. The computer-controlled slot machines are generally linked to a wide area network, facilitating tournament play among multiple players and progressive jackpots. Computer-controlled slot machines include machine-readable media reading and writing devices, allowing players to save and restore games in progress.

15 Claims, 9 Drawing Sheets

U.S. PATENT DOCUMENTS

| | | | | | |
|---|---|---|---|---|---|
| 4,467,424 | A | | 8/1984 | Hedges et al. | |
| 4,494,197 | A | | 1/1985 | Troy et al. | |
| 4,506,890 | A | | 3/1985 | Murry | |
| 4,517,656 | A | | 5/1985 | Solimeno et al. | |
| 4,564,923 | A | | 1/1986 | Nakano | |
| 4,570,930 | A | | 2/1986 | Matheson | |
| 4,572,509 | A | | 2/1986 | Sitrick | |
| 4,614,342 | A | | 9/1986 | Takashima | |
| 4,636,174 | A | | 1/1987 | Andersen et al. | |
| 4,648,602 | A | * | 3/1987 | Maroney | 273/146 |
| 4,760,527 | A | | 7/1988 | Sidley | |
| 4,836,553 | A | | 6/1989 | Suttle et al. | |
| 4,837,728 | A | | 6/1989 | Barrie et al. | |
| 4,861,041 | A | | 8/1989 | Jones et al. | |
| 4,961,581 | A | | 10/1990 | Barnes et al. | |
| 4,986,546 | A | | 1/1991 | Cerulla | |
| 4,995,615 | A | | 2/1991 | Cheng | |
| 5,043,889 | A | | 8/1991 | Lucey | |
| 5,129,652 | A | | 7/1992 | Wilkinson | |
| 5,221,083 | A | | 6/1993 | Dote | |
| 5,290,033 | A | | 3/1994 | Bittner et al. | |
| 5,356,140 | A | | 10/1994 | Dabrowski et al. | |
| 5,374,060 | A | | 12/1994 | Goldberg | |
| 5,393,067 | A | | 2/1995 | Paulsen et al. | |
| 5,417,424 | A | | 5/1995 | Snowden et al. | |
| 5,462,277 | A | | 10/1995 | Takemoto | |
| 5,472,195 | A | | 12/1995 | Takemoto et al. | |
| 5,489,096 | A | | 2/1996 | Aron | |
| 5,564,977 | A | | 10/1996 | Algie | |
| 5,611,730 | A | | 3/1997 | Weiss | |
| 5,669,817 | A | | 9/1997 | Tarantino | |
| 5,687,968 | A | | 11/1997 | Tarantino | |
| 5,732,948 | A | | 3/1998 | Yoseloff | |
| 5,772,509 | A | | 6/1998 | Weiss | |
| 5,788,240 | A | | 8/1998 | Feinberg | |
| 5,803,451 | A | * | 9/1998 | Kelly et al. | 273/118 R |
| 5,823,874 | A | | 10/1998 | Adams | |
| 5,823,875 | A | | 10/1998 | Tarantino | |
| 5,833,538 | A | | 11/1998 | Weiss | |
| 5,839,960 | A | * | 11/1998 | Para et al. | 463/44 |
| 5,848,932 | A | | 12/1998 | Adams | |
| 5,964,463 | A | | 10/1999 | Moore, Jr. | |
| 5,984,779 | A | | 11/1999 | Bridgeman et al. | |
| 6,120,377 | A | * | 9/2000 | McGinnis, Sr. et al. | 463/20 |
| 6,173,955 | B1 | * | 1/2001 | Perrie et al. | 273/146 |
| 6,213,876 | B1 | * | 4/2001 | Moore, Jr. | 463/22 |

OTHER PUBLICATIONS

Author unknown, "www.hasbro.com/sampler/index.html," Hasbro, 1 pg., 1996.

Author unknown, "www.yahtzee.com," Hasbro, 2 pgs., 1996.

Author unknown, "Yahtzee Instructions," Milton Bradley Company, pp. 1–8, 1996.

Burns, B., "The Encyclopedia of Games," Barnes and Noble, Inc., pp. 198–199, 1998.

Dugdale, S., "Using the Computer to Foster Creative Interaction Among Students," Plato Education Group, CERL Report E–9, pp. 1–14, Oct., 1979.

Stewart, G., "Commbat: A Tele–Game for Two," BYTE Publications Inc., pp. 100–104, Dec., 1981.

Stifle, J.E., "The Plato V Terminal," Plato Education Group, CERL Report x–50, pp. 1–58, Aug., 1977.

Wadlow, T.A., "The Xerox Alto Computer," BYTE Publications Inc., In the Queue, vol. 6, No. 9, pp. 58–63, Sep., 1981.

Wells, A., Baldwin, B., and Quarterman, S., "Documentation for Trek 2.1," pp. 1–19, Aug., 1979.

Wasserman, K., and Stryker, T., "Multimachine Games," BYTE Publications Inc., pp. 24–39.

* cited by examiner

COMPUTER-CONTROLLED GAMING APPARATUS AND METHOD

CROSS REFERENCE TO RELATED APPLICATION

This application is a continuation-in-part of Ser. No. 09/298,604 filed on Apr. 23, 1999, now abandoned, which is incorporated herein by reference.

FIELD OF THE INVENTION

The present invention relates generally to gaming systems, and in particular to computer-controlled casino dice games.

BACKGROUND OF THE INVENTION

Traditional slot machine play typically involves wagering on the spin of a mechanical or video-simulated reel. No decision making is involved, other than the decision to play. No skill is involved where the outcome of such gaming is based upon chance.

The interconnection of multiple gaming machines to facilitate a gaming system with progressive jackpots is in use today. Although such wide area links involve progressive jackpots, they do not take full advantage of the potential created by the interconnection of a plurality of gaming machines. Wide area links of gaming machines typically involve traditional computer-controlled slot machines, which, although popular, do not involve a substantial skill element.

Furthermore, traditional slot machines facilitate a limited persistence of play. After any given spin, a player is likely to leave the computer-controlled slot machine, because each spin is a completed cycle rather than part of an ongoing game. A game in which each spin or turn is a part of an ongoing game would be advantageous because such a system would encourage a player to continue playing in order to complete a game in progress.

Additionally, traditional slot machine play is a solitary activity. Players compete only against the house, in an introverted process in which they interact not with each other, but only with the gaming machines. With the advent of wide area links of gaming machines, a tremendous potential exists to facilitate multiple player tournaments, in which players would not only compete for the same progressive jackpots, but actually compete against each other in real time. Such multiple player gaming would be more socially interactive, and would facilitate a fun gaming dynamic.

Also, traditional slot machines are not equipped to permit a player to take a break, and to later resume game play. If a player physically leaves an individual slot machine, that player may never revisit the specific game state which the player left behind. Because players like to take short and long term breaks for a variety of reasons, a method to allow a player to save a game state and later restore the saved game would be advantageous. Players would like to be able to take breaks of any length and later resume a saved game at the same or another physical location.

SUMMARY OF THE INVENTION

The present invention provides apparatus and method for the playing various casino games on a variation of a standard computer-controlled slot machine. One such game is designated herein by the term Check. In the game of Check, a player spins (rolls) five simulated dice to obtain certain scoring combinations during each turn. Each turn lasts from one to three spins. After the first spin, a player may end the turn or spin again. If a player spins again, the player may re-spin all of the dice, or hold any number of the dice and re-spin the others. After a maximum of three spins in this manner, the turn ends. Once a turn is over, the player must assign the result of the dice to one of a number of categories on a scorecard. If the result of the dice does not fit any of the categories, the player must assign a zero to one of the categories. Over the course of multiple turns, the player attempts to fill out the multiple predefined categories on the scorecard. The game is over when the player has filled all of the predefined categories and the resulting point values are accumulated.

The game of Check involves a substantial skill element. During the course of a game, a player must make various decisions, for example, whether to assign an existing score to a category or to roll again, which dice to roll again and which dice to hold, and to which category to assign a score. The outcome of the game and the amount of a player's winnings or losses are directly dependent upon the decisions the player makes.

Another such game is denoted herein by the term Z Sixty Six. In the game of Z Sixty Six, a player spins (rolls) six simulated dice to obtain three, four, five, and six of a kind. A player must achieve a minimum of three of a kind in order to begin a game. Each turn of a game lasts from one to three spins. During the first spin of a turn, a player spins all six dice, attempting to achieve a resulting combination in which at least three of the dice are of the same numerical value. After the first spin of a turn, the number displayed by the largest plurality of the dice automatically becomes a target number for the current turn. The dice displaying the target number are automatically held, and if at least three dice displaying the target number have been generated, points are assigned to a score area associated with the target number.

After the first spin, the player re-spins the dice that were not held, attempting to generate more dice displaying the target number. Where more dice displaying the target number are generated, a predetermined number of points is added to the appropriate scoring category, and the additional scoring dice are held. After a maximum of three spins total, the turn ends. Over the course of multiple turns, the player attempts to fill out the multiple predefined, scoring categories. The game is over when the player has filled all of the predefined categories.

In both Check and Z Sixty Six, the player inserts coins (or utilizes credit play) for each spin (roll) of the dice, and is paid for filling the categories. Payouts are dependent upon the category filled, and the number of rolls needed to achieve the scoring dice combinations. Bonuses may be paid for successfully completing the scorecard.

Furthermore, both games directly facilitate persistence of play. Each spin is part of an ongoing game. A player is encouraged to continue playing to complete turns and games in order to maximize the resulting point values or scores accumulated on the scorecard.

The computer-controlled slot machines may be interlinked onto a local and wide-area network with other computer-controlled slot machines. This facilitates multiple player tournaments in which players compete against each other in real time, in contrast to playing "against the house." The wide area network also facilitates the payment of progressive or other special jackpots. The wide-area link may have progressive jackpots or flat-rate jackpots, and these prizes may be paid daily, weekly, monthly, and/or yearly.

The present invention also includes a method to save and restore games in progress. A player may save a game onto a magnetic card, bar coded voucher, or other machine-readable medium. The player may later resume the saved game by inserting the machine-readable medium into any similar computer-controlled slot machine, either at the same location, or elsewhere on the wide area network. The computer-controlled slot machine is then initialized to the conditions and states determined by the saved game information from the machine-readable medium, and the player may resume the game from where previously terminated.

DETAILED DESCRIPTION OF THE PREFERRED EMBODIMENTS

Figure 1:
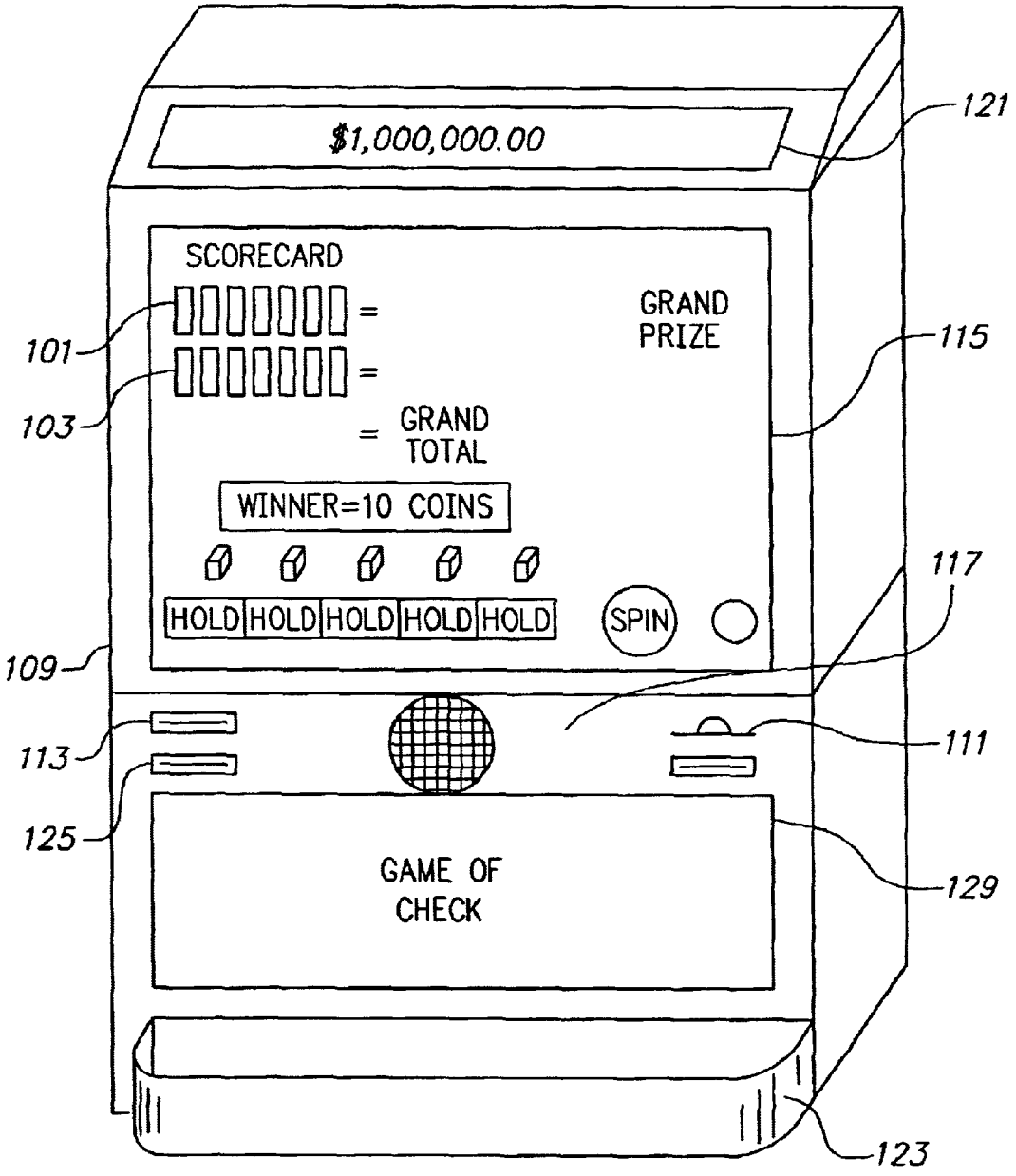
FIG. 1 is a perspective view of a computer-controlled slot machine, in accordance with one embodiment of the gaming system of the present invention.

In a preferred embodiment of the present invention, the games of Check and Z Sixty Six are played on a computer-controlled slot machine, for example as shown in FIG. 1. The computer-controlled slot machine 101 includes a microprocessor-controlled computer 103 within a tamper-proof and lockable cabinet 109 having a coin acceptor 111 for wagers and a bill validator 113 for wager, and preferably including a touch-sensitive display 115 for player input and game display. In addition, the computer-controlled slot machine includes a sound speaker 17 for output of digital sound and voice simulations, a tower light [119] (not shown) to indicate jackpots and other game statistics, and a meter 121 to display progressive jackpot information and other text. The computer 103 controls release of coins to a coin hopper 123 for paying players, and controls a ticket printer 125 for generating vouchers. The computer 103 also controls a machine-readable medium reading and writing device 129 for saving and restoring games in progress.

Figure 2:
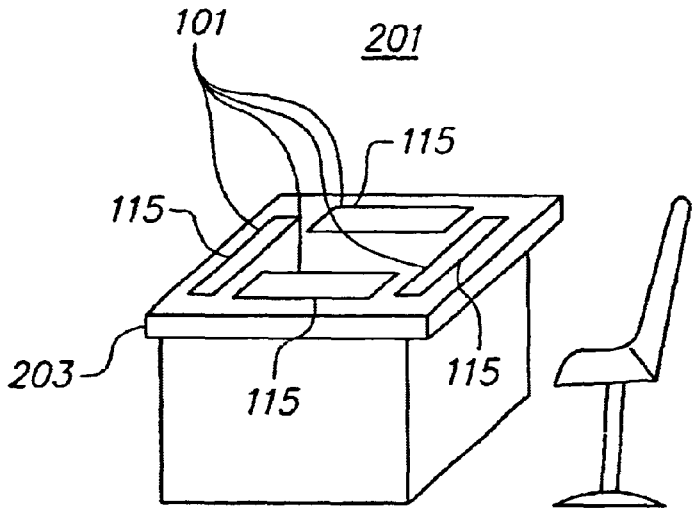
FIG. 2 is a perspective view of four computer-controlled slot machines assembled in a bar table according to another embodiment of the present invention for single or simultaneous multiple user play.

An alternative embodiment of the computer-controlled slot machine is illustrated in FIG. 2. A "bar buddy" version of a computer-controlled slot machine 201 includes all of the features of the computer-controlled slot machine 101. Each "bar buddy" computer-controlled slot machine 201 contains four such computer-controlled slot machines 101, assembled within a bar table 203. Each of the four touch-sensitive displays 115 for player input and game display are mounted in the surface of the bar table 203. The bar buddy computer-controlled slot machine 201 enables from one to four players to play Check or Z Sixty Six simultaneously, either against each other or against the house. The various modes of game play are detailed below.

Figure 3:
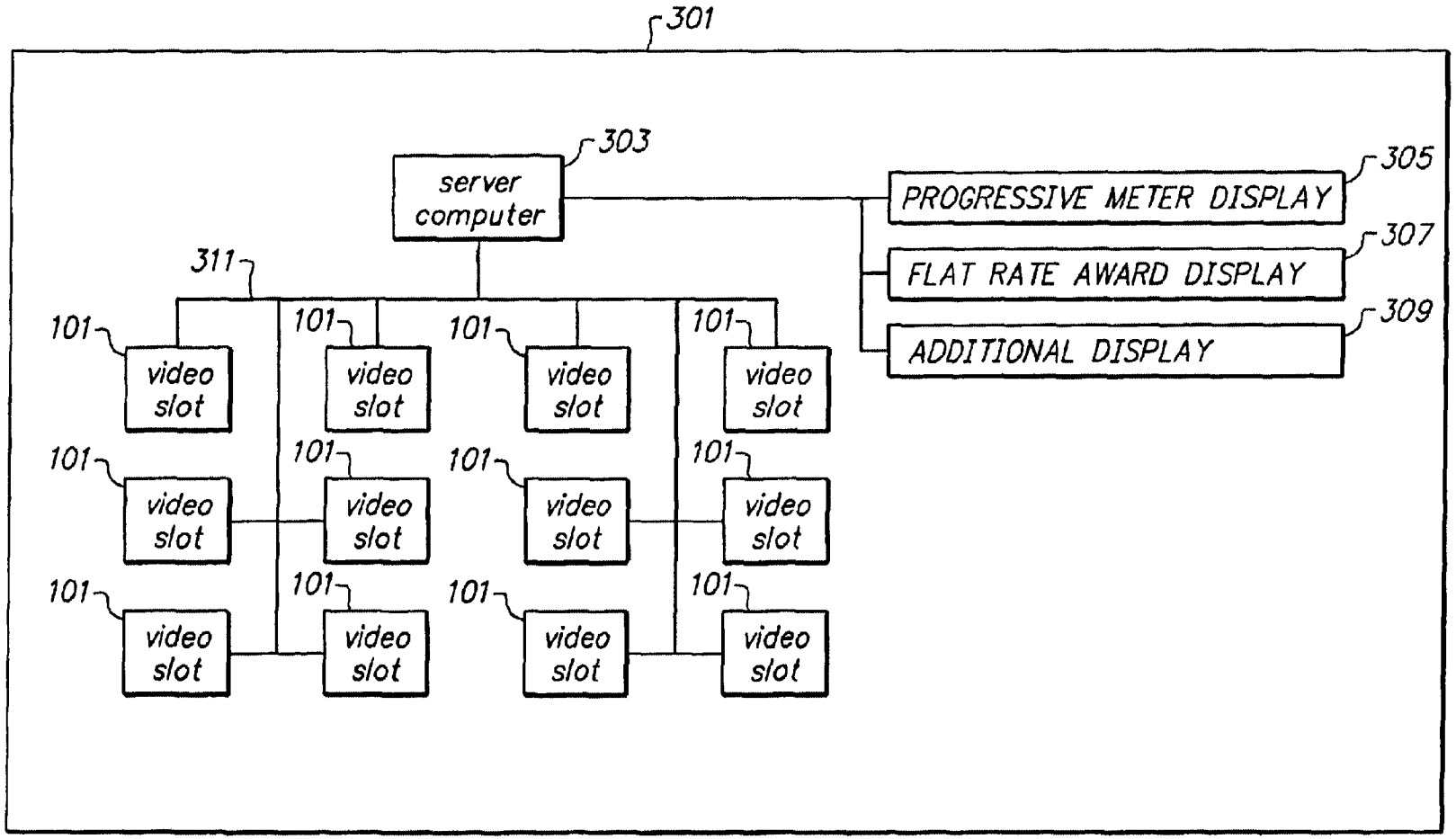
FIG. 3 is a block diagram of a local area network of computer-controlled slot machines, according to the present invention for progressive gaming activity.

Each computer-controlled slot machine 101 is preferably connected to a local area computer network as illustrated in FIG. 3. The local area computer network 301 is controlled by a microprocessor-controlled server computer 303 which controls game play, records game statistics, accounts for vouchers and jackpots, and links the games together. The local area computer network 301 also preferably includes a progressive meter display 305 for showing progressive jackpot information. a flat rate award display 307 for showing flat rate jackpot information, and an additional display 309 for showing the scores that presently qualify for jackpots on the local area network 301. In the preferred embodiment of the present invention, all of the computer-controlled slot machines 101 are connected to the local area computer network 301 in conventional manner via private dedicated lines 311. In an alternative embodiment, some or all of the computer-controlled slot machines 101 positioned at remote locations are connected to the local area computer network 301 via modems and public telephone lines operated in secure mode through encryption/decryption techniques.

Figure 4:
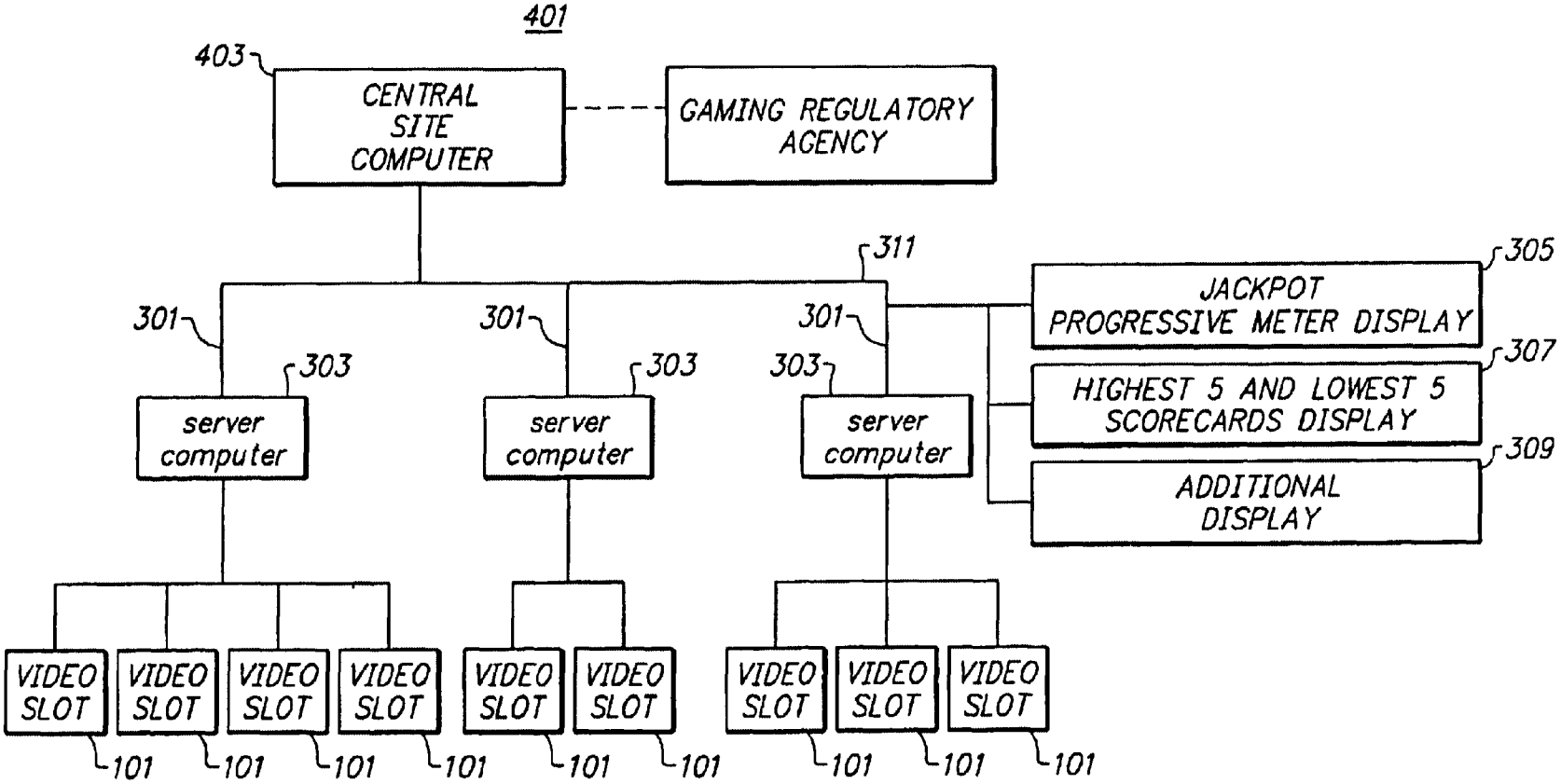
FIG. 4 is a block diagram of a wide area network of computer-controlled slot machines, according to the present invention for progressive gaming activity.

Each local area network 301 of computer-controlled slot machines 101 may be connected to a wide area computer network as illustrated in FIG. 4. The wide area computer network 401 includes local area computer networks 301 at various physical locations. The wide area computer network 401 is controlled by a central-site computer 403 which operates in 24-hour-a-day communication with all local area computer networks 301 on the wide area computer network 401 for security, accounting, and verification of games and jackpots. If a local area computer network 301 is connected to a wide area computer network 401, the progressive meter display 305, the flat rate award display 307, and the additional display 309 of that local area computer network 301 all display jackpot and other information pertaining to the entire wide area network 401. For example, the additional display 309 of a local area computer network 301 which is connected to a wide area computer network 401 shows scores that presently qualify for jackpots on the wide area network 401. In the preferred embodiment of the present invention, each local area computer network 301 is connected to the wide area computer network 401 in conventional secured cryptographic manner via private dedicated lines 311. In an alternative embodiment, some or all of the local area computer networks 301 are connected to the wide area computer network 401 in secured cryptographic manner via modems and public telephone lines.

Figure 5A:
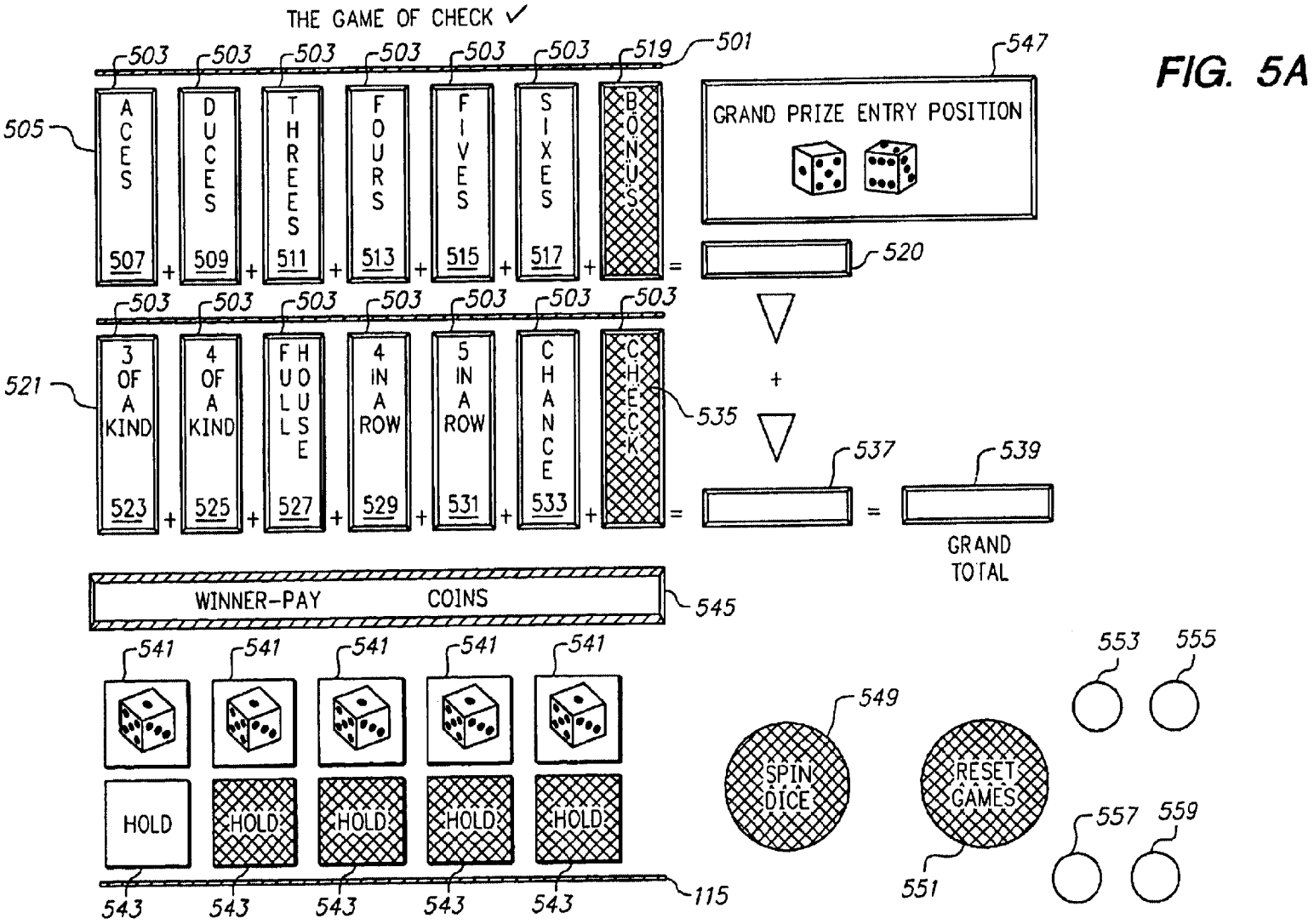
FIG. 5A is a diagram of a touch-sensitive display of a computer-controlled slot machine, in accordance with one embodiment of the gaming system of the present invention.

In a preferred embodiment of the present invention, the computer-controlled slot machine 101 includes a touch-sensitive display 115 for player input and game display. FIG. 5A illustrates the layout of the touch-sensitive display in accordance with an embodiment of the present invention for playing the game of Check. The touch-sensitive display 115 allows the player to make input selections conveniently, and displays game information in various ways, depending upon game state. The upper left area of the display 115 displays a scorecard 501 which includes thirteen dual purpose score areas 503 pertaining to the thirteen possible scoring categories. These areas are utilized to accept a player's selection of a scoring category after achieving a scoring spin, and also to display the score achieved by a player in that category, as detailed below with respect to game play.

The computer-controlled display scorecard 501 is divided into two portions. The upper portion 505 of the scorecard 501 includes dual purpose score areas 503 of the display for Ones (or Aces) 507, Twos (or Deuces) 509, Threes 511, Fours 513 , Fives 515, and Sixes 517. If the player exceeds a pre-determined score threshold on the upper portion 505 of the scorecard 501, the player is awarded a bonus score which is displayed in the bonus score display area 519 of the upper portion 505 of the scorecard 501. The upper portion 505 of the scorecard 501 also includes an upper portion score total display area 520 for displaying the total of all of the scores achieved in the scoring categories of the upper portion 505 of the scorecard 501. A detailed explanation of scoring is provided below with respect to game play.

The lower portion 521 of the display scorecard 501 includes dual purpose score areas 503 for 3-of-a-Kind 523, 4-of-a-Kind 525, Full House 527, a four-dice Straight 529, a five-dice Straight 531, the sum of all five dice (or Chance) 533, and 5-of-a-Kind (or Check) 535. The lower portion 521 of the scorecard 501 also includes a lower portion score total display area 537 for displaying the total of all of the scores achieved in the scoring categories of the lower portion 521 of the scorecard 501.

The display 115 includes a grand total score display area 539 which displays a player's grand total score as the sum of the upper portion score total and the lower portion score total.

The bottom left area of the display 115 includes five simulated dice 541. The bottom left area of the display 115 includes five hold buttons 543 immediately below the simulated dice 541. These hold buttons 543 are touch-sensitive areas, and are for holding a specific simulated die 541 on a series of spins (rolls) when the player is attempting to obtain a certain combination, as detailed below with respect to game play.

The middle left area of the display 115 includes a text message box 545 for informing players of games states, such as number of spins remaining, winning combinations, game over, and for informing players of the amount of payouts.

The upper right area of the display 115 includes a message area 547 showing the position of the current scorecard 501 in the daily, weekly, monthly, or yearly prize jackpot award among multiple player networks for the prevailing scores. Alternatively, the message area 547 may show the top five scores on a multiple-player network that qualify for a jackpot, as well as the bottom five scores that so qualify, so that the player can see scores required to achieve a jackpot, as detailed below with respect to jackpots.

The bottom right area of the touch-sensitive display 115 includes a number of touch-sensitive areas which facilitate configuration and control of the game of Check. Specifically, a touch-sensitive spin button 549 activates a spin (roll) of the simulated dice 541, a touch-sensitive reset button 551 resets the scorecard 501, and a touch-sensitive start game button 553 starts a game. A touch-sensitive wager button 555 allows a player to select the number of credits to wager, a touch-sensitive game mode selection button 557 allows a player to switch between game modes, and a touch-sensitive save-restore game button 559 allows a player to save or restore a game in progress to or from a card or voucher of machine-readable medium. Of course, the various buttons or control inputs, for example 543, 549, 551, 553, 555 and 557, described herein as touch-sensitive areas on the display, 115 may also be provided as mechanical electrical input devices, as desired.

Figure 5B:
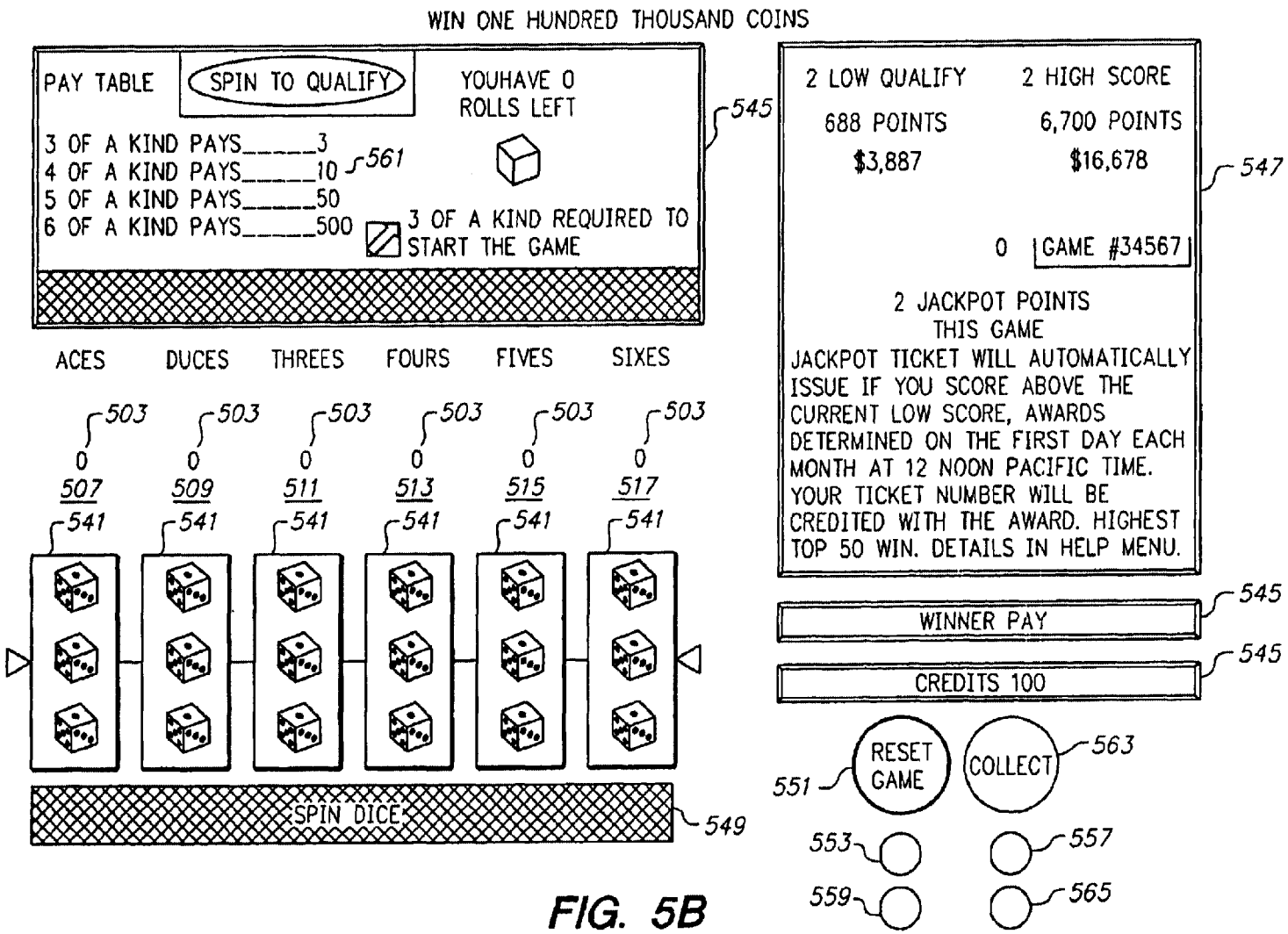
FIG. 5B is a diagram of a touch-sensitive display of a computer-controlled slot machine, in accordance with an alternative embodiment of the gaming system of the present invention.

FIG. 5B illustrates the layout of the touch-sensitive 115 display in accordance with an embodiment of the present invention for playing the game of Z Sixty Six. The touch-sensitive display 115 allows the player to make input selections conveniently, and displays game information in various ways, depending upon game state. The upper left area of the display 115 displays a paytable 561 which indicates predetermined amounts to be paid for achieving specific scoring combinations. The paytable 561 is updated as the game progresses to reflect predetermined amounts to be paid for achieving scoring combinations at different stages of game play.

Below the paytable 561 are six score areas 503 of the display 115. There is a score area for Ones (or Aces) 507, for Twos (or Deuces) 509, for Threes 511, for Fours 513 , for Fives 515, and for Sixes 517. Scoring combinations are assigned to appropriate score areas 503. A detailed explanation of scoring is provided below with respect to game play.

The bottom left area of the display 115 includes six simulated dice 541. In the embodiment shown in FIG. 5B, the simulated dice are in the form of a video simulated dice reels. Below the video simulated dice 541 is a touch sensitive spin button 549 that activates a spin (roll) of the simulated dice 541. In the embodiment illustrated in FIG. 5B, the spin button 549 is in the form of one spin bar common to all simulated dice 541 on the display 115.

The upper central area of the display 115 includes a text message box 545 for informing players of games states, such as number of spins remaining, winning combinations, game over, and for informing players of the amount of payouts. The upper right area of the display 115 includes a message area 547 showing the top score on a multiple-player network that qualifies for a jackpot, as well as the bottom score that so qualifies, so that the player can see scores required to achieve a jackpot, as detailed below with respect to jackpots. Alternatively, the message area 547 may show the position of the current score in the daily, weekly, monthly, or yearly prize jackpot award among multiple player networks for the prevailing scores.

In the embodiment illustrated in FIG. 5B, a text message box 545 for informing players of payout amounts, and a text message box 545 for informing players of the number of accumulated credits are located below the message area 547.

The bottom right area of the touch-sensitive display 115 includes a number of touch-sensitive areas which facilitate configuration and control of the game of Z Sixty Six. A touch-sensitive reset button 551 resets the game, and a touch-sensitive start game button 553 starts a game. A touch-sensitive game mode selection button 557 allows a player to switch single and multiple-player game modes. A touch-sensitive save-restore game button 559 allows a player to save or restore a game in progress to or from a card or voucher of machine-readable medium. A touch-sensitive collect button 563 allows a player to collect accumulated winnings. In one embodiment, a touch-sensitive translate button 565 allows a player to select a language to be used for display output. Of course, the various buttons or control inputs, for example 551, 553, 557, and 559 described herein as touch-sensitive areas on the display 115, may also be provided as mechanical electrical input devices, as desired.

Figure 6:
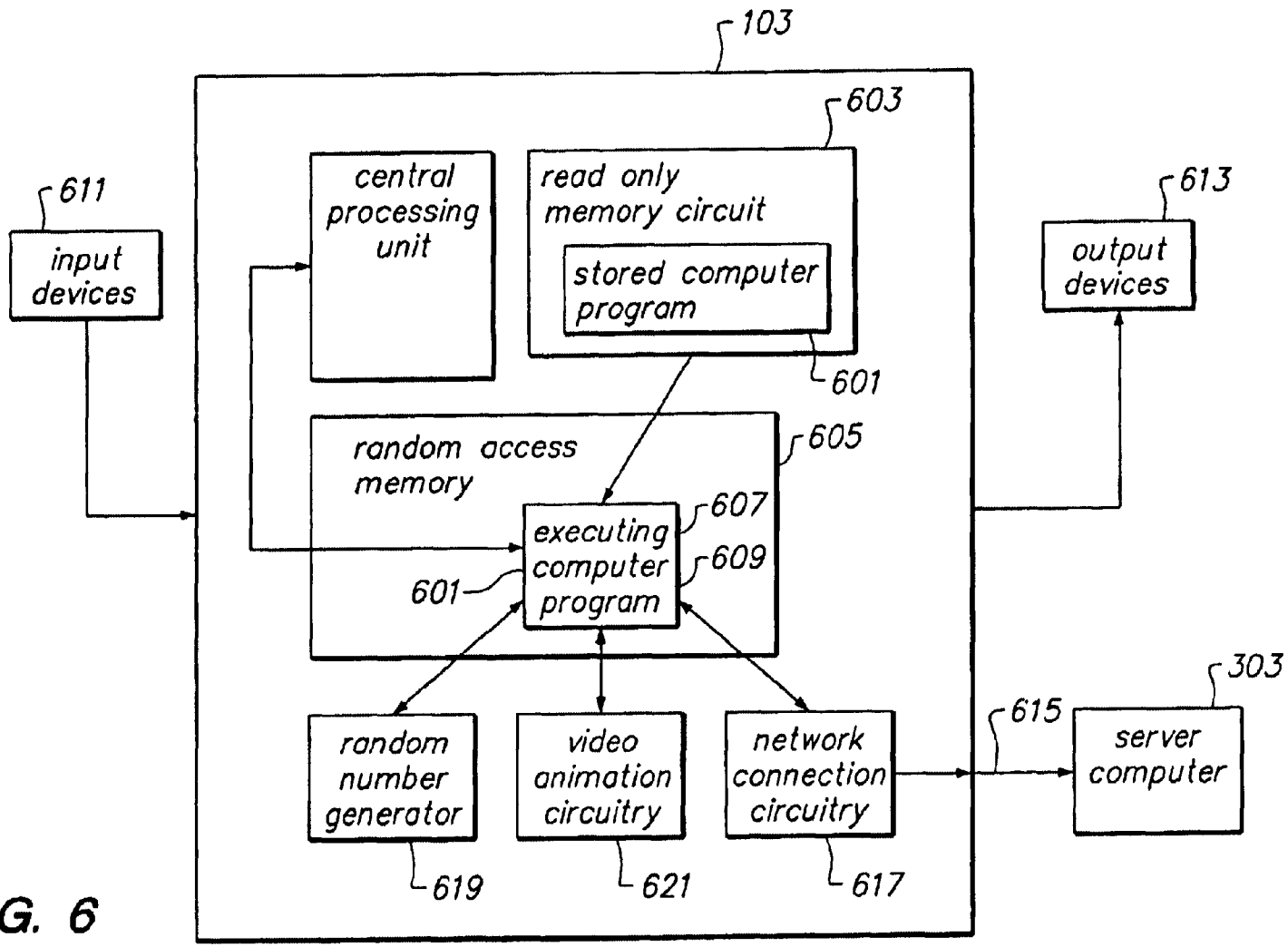
FIG. 6 is a block diagram of the microprocessor-controlled computer and the computer program which facilitate game play according to one embodiment of the present invention.

FIG. 6 illustrates the computer system that facilities game play. In a preferred embodiment of the present invention for playing the game of Check, game play is facilitated by a computer program 601 executing in the microprocessor-controlled computer 103 within the computer-controlled slot machine 101. In the preferred embodiment of the present invention, the computer program is stored on a read-only memory integrated circuit 603 that is operatively coupled to the microprocessor-controlled computer 103 in the computer-controlled slot machine 101. Of course, in alternative embodiments, the computer program may be stored on various other storage media, such as semiconductor memory or optical or magnetic disk, or the like.

The computer program 601 executes from the random access memory 605 of the microprocessor-controlled computer 103 in the computer-controlled slot machine 101, and includes code 607 and data 609 to facilitate the play of the game of Check in accordance with the game rules, as detailed below with respect to game play.

The computer program accepts user input from various user input devices 611 of the types previously described, including coin acceptor 111, bill validator 113, the touch-sensitive display 115, and the machine-readable medium reading and writing device 129. Other input devices including mechanical button type switches and lever-arm switch actuators may be used in alternative embodiments as desired.

The computer program also controls computer operation of the various output devices 613 such as the display 115, the sound speaker 117, a tower light 119, the meter 121, the coin hopper 123, the ticket printer 125, and the machine-readable medium reading and writing device 129.

Preferably, the computer program 601 also controls communication with the microprocessor-controlled server computer 303 which controls the local area computer network 301. The computer program 601 controls this communication via a network port 615 and network connectivity circuitry 617 contained within the microprocessor-controlled computer 103.

The computer program 601 utilizes a random number generator 619 to produce random numbers that represent the results of the simulated rolling of the simulated dice 541. The computer program 601 utilizes animation circuitry 621 to produce the simulation of dice on the display 115.

Figure 7:
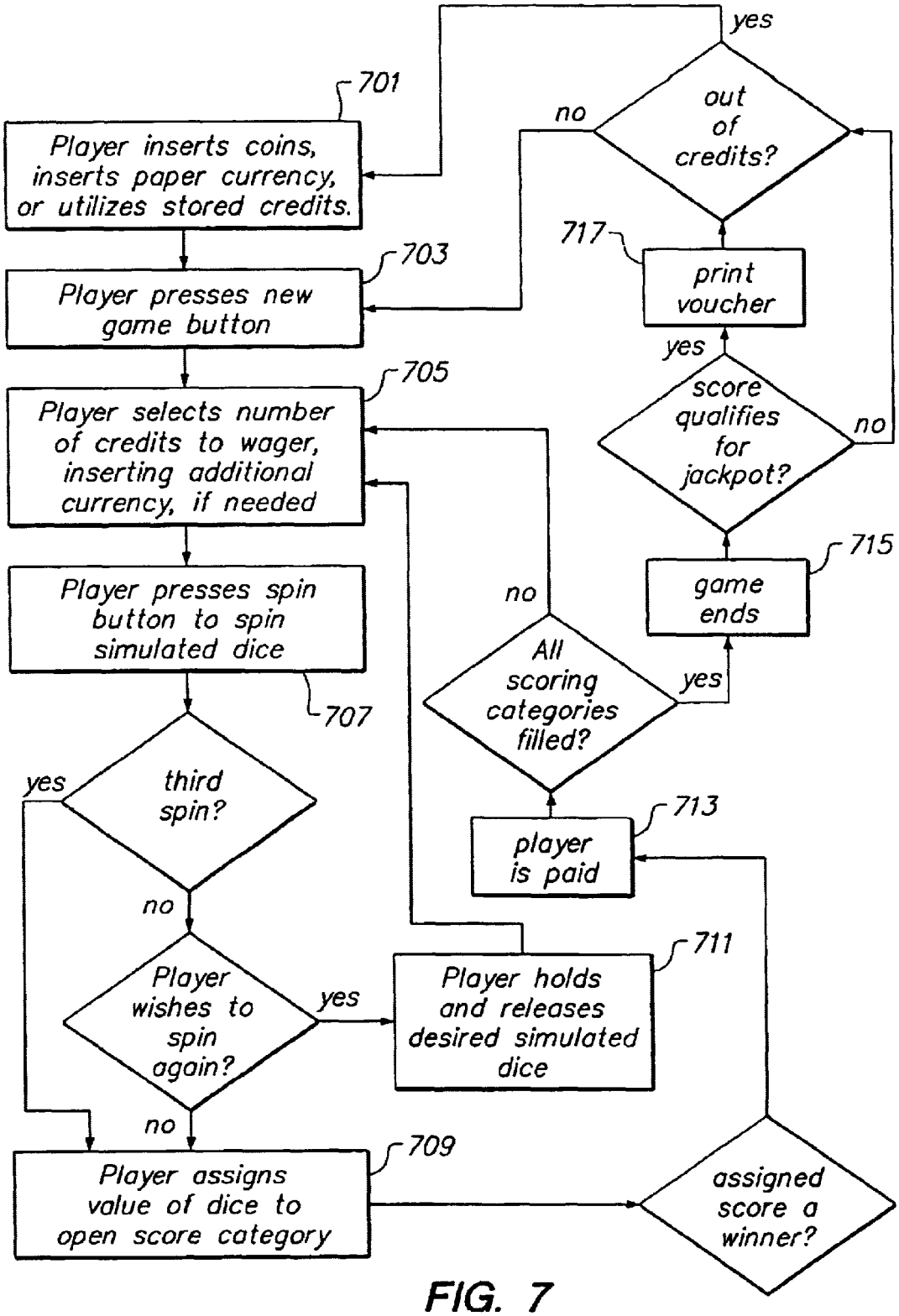
FIG. 7 is a flowchart illustrating the steps of game play according to one embodiment of the present invention.

FIG. 7 is a flowchart, illustrating play of the game of Check according to one embodiment of the present invention. The object of the game is to 'spin' the simulated dice 541 for scoring combinations, and to get the highest total score accumulated within scoring categories of possible dice combinations. A player begins by inserting 701 one or more coins into the coin acceptor 111, by inserting 701 one or more bills into the bill validator 113, or by utilizing credits. The player then presses 703 the touch-sensitive start game button 553 to begin game play. The player then selects 705 the number of credits to wager on the spin of the simulated dice 541 by utilizing the touch-sensitive wager button 555 which controls the selection of the number of credits to be wagered. The player next spins 707 the simulated dice 541 by pressing the touch-sensitive spin button 549. The computer program 601 utilizes the random number generator 619 to produce random numbers that represent the results of the simulated roll of the simulated dice 541.

On each turn, the player may spin 707 the simulated dice 541 up to three times in order to get the highest scoring combination for one of thirteen scoring categories. The thirteen scoring categories are illustrated by the following table:

| | How the Dice Score |
|---|---|
| Upper Portion of Scorecard | |
| One (or aces) | Total of dice showing One only |
| Twos (or Deuces) | Total of dice showing Two only |
| Threes | Total of dice showing Three only |
| Fours | Total of dice showing Four only |
| Fives | Total of dice showing Five only |
| Sixes | Total of dice showing Six only |
| Bottom Portion of Scorecard | |
| 3-of-a-kind | Total of all five dice |
| 4-of-a-Kind | Total of all five dice |
| Full House (3 of one number, 2 of another number) | 25 |
| Four-Dice Straight | 30 |
| Five-Dice Straight | 40 |
| 5-of-a-Kind (or a Check) | 50 |
| Chance (any five dice) | Total of all five dice |

After each spin the player may assign 709 the value of the simulated dice 541 to one of the possible scoring categories by utilizing the dual purpose score areas 503 of the touch-sensitive display 115. If a player does so, the computer under program control senses the touched areas 503 and totals the value of the simulated dice 541 and calculates and displays the resulting score in the dual purpose score area 503 on the touch-sensitive display 115. The total score of the upper portion 505 of the scorecard 501 is displayed on the upper portion score total display area 520 on the touch-sensitive display 115. If the total score of the upper portion 505 of the scorecard 501 is 63 or higher, for example, then a bonus of 35 points, for example, is added to the upper portion score. This bonus is displayed on the bonus score display area 519 on the display 115. The total score of the lower portion 521 of the scorecard 501 is displayed on the lower portion score total display area 537 on the display 115. The grand total score is calculated by adding the upper portion and the lower portion scores together. The grand total score is displayed on the grand total score display area 539 on the display 115.

Each scoring category can only be scored or selected once during a game. Once a category is used, it cannot be reused until the next game either when the game is over because the scorecard 501 is complete or the player presses the touch-sensitive reset button 551. Pressing the touch-sensitive reset button 551 clears the entire scorecard 501 in preparation for the start of a new game.

Instead, if the player has not yet spun 707 three times during the present turn, the player may elect not to assign 709 the value of the simulated dice 541, but instead to spin 707 again. If the player elects to spin 707 again, the player may hold 711 one or more of the simulated dice 541 by pressing one or more of the associated hold button(s) 543. The player may also release 711 one or more of any held simulated dice 541 by again pressing the associated hold button(s) 543. The player may also elect not to hold or release 711 any of the simulated dice 541. The player then selects 705 the number of credits to wager on the spin of the simulated dice 541 by utilizing the touch-sensitive wager button 555. The player next spins 707 the simulated dice 541 by pressing the touch-sensitive spin button 549.

A turn is over after a player has spun 707 three times, or has assigned 709 the value of the simulated dice 541 to one of the possible scoring categories by utilizing the dual purpose score areas 503 of the touch-sensitive display 115. After a player has spun 707 three times, the player must assign 709 the value of the simulated dice 541 to one of the possible scoring categories by utilizing the dual purpose score areas 503 of the touch-sensitive display 115. If the score cannot be placed into one of the categories because it does not correspond or qualify, then the player must utilize the dual purpose score areas 503 of the touch-sensitive display to assign 709 a zero to one of the remaining categories.

If the player has achieved a scoring combination and assigns 709 it to one of the scoring categories, the player is paid 713 via the coin hopper 123. Alternatively, the player may elect to receive credits. The computer program 601 calculates payment according to a paytable, which is based upon points scored per turn, and the number of spins needed to achieve the points, as shown, for example, in the following table:

| | NUMBER OF COINS | | |
|---|---|---|---|
| CATEGORY | ×3 Spin 1 | ×2 Spin 2 | ×1 Spin 3 |
| ONES | TOTAL × 3 | TOTAL × 2 | TOTAL OF 1's |
| TWOS | TOTAL × 3 | TOTAL × 2 | TOTAL OF 2's |
| THREES | TOTAL × 3 | TOTAL × 2 | TOTAL OF 3's |
| FOURS | TOTAL × 3 | TOTAL × 2 | TOTAL OF 4's |
| FIVES | TOTAL × 3 | TOTAL × 2 | TOTAL OF 5's |
| SIXES | TOTAL × 3 | TOTAL × 2 | TOTAL OF 6's |
| 3 of a Kind | TOTAL × 3 | TOTAL × 2 | TOTAL × 1 |
| 4 of a Kind | TOTAL × 3 | TOTAL × 2 | TOTAL × 1 |
| Full House | 75 | 50 | 25 |
| Small Straight | 90 | 60 | 30 |
| Large Straight | 120 | 80 | 40 |
| Chance | TOTAL × 3 | TOTAL × 2 | TOTAL × 1 |
| Check | 150 | 100 | 50 |
| Check Bonus 1 | 300 | 250 | 100 |
| Check Bonus 2 | 300 | 200 | 100 |
| Check Bonus 3 | 300 | 200 | 100 |

| SCORECARD BONUSES | |
|---|---|
| TOP HALF 63+ POINTS | +35 COINS |
| ALL CATEGORIES FILLED | +100 COINS |
| SCORE 250–299 PTS. | +50 COINS |
| SCORE 300–349 PTS. | +100 COINS |
| SCORE 350–399 PTS. | +150 COINS |
| SCORE 400–449 PTS. | +200 COINS |
| SCORE 450–499 PTS. | +250 COINS |
| SCORE 500–549 PTS. | +300 COINS |
| SCORE 550–599 PTS. | +350 COINS |
| SCORE 600–644 PTS. | +400 COINS |
| PERFECT SCORE | +6000 COINS |

If the player assigns 709 a zero score to one of the categories, the player is not paid. Alternative embodiments may employ different paytables, as desired.

The player may then proceed with the next turn and continue filling the scorecard 501. To proceed with the next turn, the player utilizes the touch-sensitive wager button 555 to select 705 the number of credits to be wagered on the spin of the simulated dice. The player next spins 707 the simulated dice 541 by pressing the touch-sensitive spin button 549 and plays a turn, as described above. The game ends 715 when the player has filled all thirteen categories with a score or a zero or is out of credits to play the computer-controlled slot machine 101.

Once the game has ended, the computer program 601 evaluates the player's scorecard 501 against other current scores to determine if a progressive jackpot will be awarded on a daily, weekly, monthly, or yearly basis. If the player has a currently qualifying scorecard 501, the computer-controlled slot machine 101 prints 717 a voucher for the player with a control number and other pertinent information for later redemption, if the scorecard 501 is a winner.

Utilizing a local area computer network 301 and a wide area computer network 401, multiple players may play the game of Check against one another instead of "against the house." Utilizing a local area computer network 301, each participating player deposits money into an individual computer-controlled slot machine 101 for each spin. The player who achieves the highest scorecard 501 of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

Figure 8:
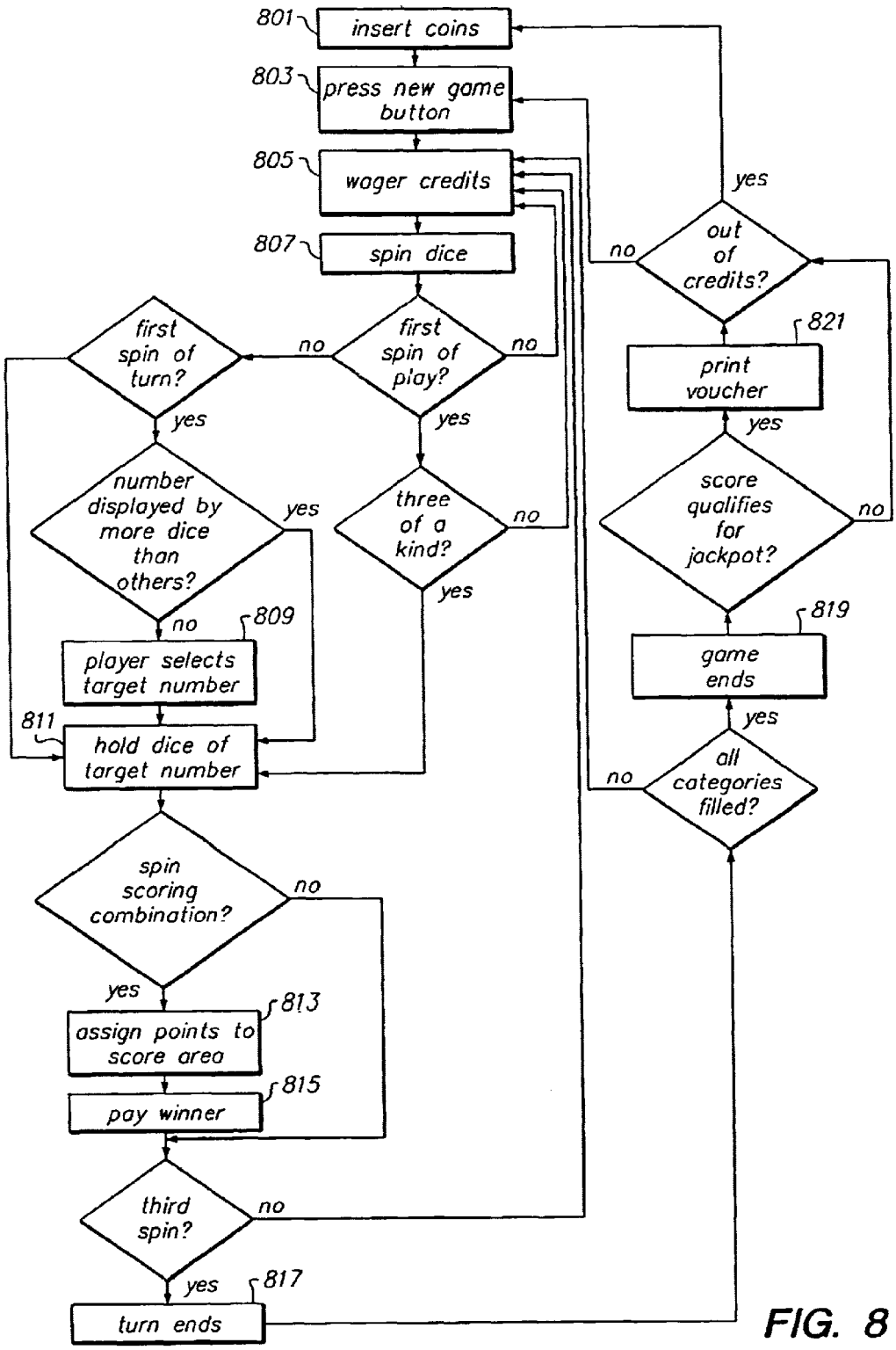
FIG. 8 is a flowchart illustrating the steps of game play according to an alternative embodiment of the present invention.

FIG. 8 is a flowchart, illustrating play of the game of Z Sixty Six according to one embodiment of the present invention. The object of the game is to 'spin' the simulated dice 541 for scoring combinations, and to get the highest total score accumulated within scoring categories of possible dice combinations. A player begins by inserting 801 one or more coins into the coin acceptor 111, by inserting 801 one or more bills into the bill validator 113, or by utilizing credits. The player then presses 803 the touch-sensitive start game button 553 to begin game play. In one embodiment, three credits are automatically wagered 805 on each spin of the simulated dice 541. In another embodiment, the player selects the number of credits to wager on the spin of the simulated dice 541 by utilizing the touch-sensitive wager button 555 which controls the selection of the number of credits to be wagered. The player next spins 807 the simulated dice 541 by pressing the touch-sensitive spin button 549. The computer program 601 utilizes the random number generator 619 to produce random numbers that represent the results of the simulated roll of the simulated dice 541.

The player must achieve at least three of kind on a single spin to begin play of an individual game. Until a spin generates at least three simulated dice 541 displaying identical numbers, the player must continue spinning 807 to attempt to generate the minimum achievement required for game entry. A wager is required for each spin of the simulated dice 541. Once a spin generates at least three simulated dice 541 displaying identical numbers, those simulated dice 541 are automatically held 811, and a predetermined number of points is automatically assigned 813 to the appropriate scoring area 503. The number of points awarded is displayed in the appropriate score area 503, which preferably changes color to indicate active status, for example as illustrated in the Appendices A1 to A36 attached hereto and formed a part hereof. The spin that generated the requisite achievement is counted as the first spin of a turn, and the scoring number becomes a target number for the remainder of the turn. A target number is a number that the player can receive points for generating during a given turn.

For example, if a first spin results in four aces (ones), the predetermined number of points for achieving four of a kind on the first spin of a first turn is automatically assigned 813 to the scoring area 503 for aces 507. Aces becomes the target number for the remainder of the turn. Thus, on the subsequent spins of the turn, the player will receive additional points only for generating aces.

The requirement of generating at least three of a kind applies only to the first turn. A player must achieve three of a kind to enter the game and begin the first turn. Once a player has generated the requisite achievement and entered the game, subsequent turns do not require a minimum achievement to begin.

On each turn, the player may spin 807 the simulated dice 541 up to three times in order to get the highest scoring combination for one of six scoring categories. The six scoring categories are illustrated by the following table:

| Score Category | How the Dice Score |
|---|---|
| One (or aces) | Dice showing One only |
| Twos (or Deuces) | Dice showing Two only |
| Threes | Dice showing Three only |
| Fours | Dice showing Four only |
| Fives | Dice showing Five only |
| Sixes | Dice showing Six only |

After the first spin of a turn, the number displayed by the largest plurality of the video simulated dice 541 automatically becomes the target number for the current turn. The simulated dice 541 of the target number are automatically held 811, and the score area 503 for the target number preferably changes color to indicate that it is the active score area 503 for the turn. If at least three dice 541 displaying the target number have been generated, a predetermined number of points is assigned 813 to the score area 503 for the target number.

If the first spin does not result in a largest plurality of dice 541 displaying any one number, the player selects 809 a target number from amongst those displayed by an equal number of the simulated dice 541. For example, if the first spin results in two aces, two deuces, one four and one five, the player may select 809 aces or deuces as the target number. The selection is made by touching the desired score area 503 of the touch-sensitive display 115. Preferably, the score areas 503 which the player may touch to choose a target number blink or change color or size or otherwise provide visual indication of the choices available.

If the player has not yet spun 807 three times during the present turn, the player may spin 807 again. The player next spins 807 the simulated dice 541 by pressing the touch-sensitive spin button 549. During the second and third spins of a turn, any generated dice 541 displaying the target number are held 811. Preselected numbers of points are assigned 813 to the appropriate scoring area 503 for scoring three, four, five, or six of the target number.

After each spin, if the player has achieved a scoring combination, the player is paid 815 via the coin hopper 123. Alternatively, the player may elect to receive credits. The number of predetermined points awarded for various scoring achievements is displayed in a paytable 545 on the display 115. The paytable 545 is adjusted as the game progresses, reflecting predetermined numbers of points to be paid for various achievements at a particular stage of the game. For example, more points are awarded for achieving a six of a kind on a first spin than on a third spin. Amounts to be paid are based upon the odds of achieving various scoring combinations at a given stage of game play, taking into account number of unheld dice to be spun, and numbers removed from possible generation. An example of a paytable 545 for a first spin of a game appears below.

| ACHIEVMENT | NUMBER OF POINTS TO BE PAID |
|---|---|
| THREE OF A KIND | 3 |
| FOUR OF A KIND | 10 |
| FIVE OF A KIND | 50 |
| SIX OF A KIND | 500 |

Alternative embodiments may employ different paytables 545, as desired.

A turn ends 817 after a player has spun 807 three times, or achieved six of the target number prior to the third spin.

Each scoring category can only be scored or selected once during a game. Once a category is used, it cannot be reused until the next game either when the game is over because a score has been assigned to each category, or the player presses the touch-sensitive reset button 551. Pressing the touch-sensitive reset button 551 terminates the current game and starts a new game. Once a scoring category for a given number has been used, that number is replaced for the remainder of the game by a non-numerical symbol, for example the letter "Z" or a graphic symbol of a piece of fruit, or as desired. During subsequent turns, when the random number generator 619 generates the used number, the non-numerical symbol is displayed instead.

After completing a turn, the player may then proceed with the next turn and continue filling the score areas 503. To proceed with the next turn, the player next spins 707 the simulated dice 541 by pressing the touch-sensitive spin button 549 and plays a turn, as described above.

The game ends 819 when the player has filled all six score areas 503 with a score, or is out of credits to play the computer-controlled slot machine 101.

Figure 9:
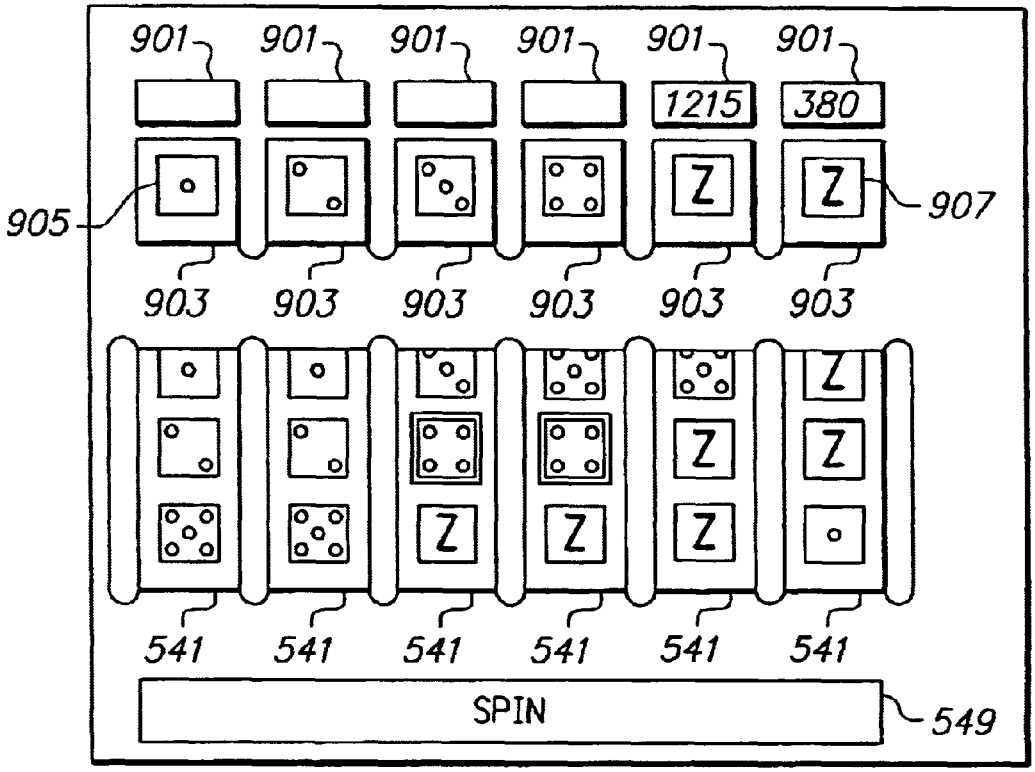
FIG. 9 is illustrates score categories comprising two distinct display areas, according to one embodiment of the present invention.

FIG. 9 illustrates an embodiment of the present invention in which each score area 503 comprises two distinct display areas. A first display area 901 is utilized to display accumulation of points for the associated scoring category. A second display area 903 identifies the associated scoring category, for example by displaying an identification video simulated die 905 displaying the number of the scoring category. Additionally, the second display area 903 is used to indicate a current target number for a turn, preferably by changing color to indicate that the number of the associated scoring category is the active target number. Also, the second display area 903 is preferably utilized to choose a target number from amongst those displayed by an equal number of the simulated dice 541 when necessary. The player chooses a target number by touching the second display area 903 associated with the chosen target number. The second display areas 903 which the player may touch to choose a target number blink or change color or size or otherwise provide visual indication of the choices available. Additionally, once a scoring category for a given number has been filled, the indicator for the associated second display area is replaced for the remainder of the game by a non-numerical symbol 907, for example the letter "Z" or a graphic symbol of a piece of fruit, or as desired.

In alternative embodiments, display of accumulated points, identification of score category, indication of current target number, indication of available choices of target number, and indication of filled categories (and in other embodiments more or fewer functions as desired) are divided between at least two display areas, in various combinations as desired.

Once the game has ended, the computer program 601 evaluates the player's score against other current scores to determine if a progressive jackpot will be awarded on a daily, weekly, monthly, or yearly basis. If the player has a currently qualifying score, the computer-controlled slot machine 101 prints 821 a voucher for the player with a control number and other pertinent information for later redemption, if the score is a winner. In various embodiment, jackpots are awarded for achieving high scores, for achieving [high scores] low scores, or for achieving both high and low scores as desired.

Utilizing a local area computer network 301 and a wide area computer network 401, multiple players may play the game of Z Sixty Six against one another instead of "against the house." Utilizing a local area computer network 301, each participating player deposits money into an individual computer-controlled slot machine 101 for each spin. The player who achieves the highest game score of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

Additionally in both Check and Z Sixty Six, daily, weekly, monthly, and yearly jackpot prizes may be awarded to any number of highest scores (or alternatively any number of lowest scores). Additional amounts may be deducted from deposited wagers (credits) to cover such jackpots which thus have the potential to become multi-million dollar jackpots. Alternatively, achieving a predetermined score may be utilized for awarding a predetermined jackpot. For instance, if a player achieves a perfect score, meaning the theoretically highest score for each category, then a jackpot may be awarded for such achievement.

Preferably, a player may save a game in progress by pressing the touch-sensitive save-restore game button 559. The computer program 601 then utilizes the machine-readable medium reading and writing device 129 to write the present scores and game states to a card or voucher. The player may later resume the saved game by inserting such card or voucher of machine-readable medium into the reading and writing device 129 of any computer-controlled slot machine 101. The saved game information is then read from the card or voucher to initialize the conditions and states of the computer-controlled slot machine 101. In various embodiments, a magnetic or optical or semiconductor medium may be used as desired to store and transfer scores and game states and other pertinent data on such card or voucher produced by the video slot machine 101.

In an alternative embodiment, the game of Check or Z Sixty Six may be played over the Internet among a random collection of players at diverse locations, forming a virtual wide area network of such competing players.

In alternative embodiments, numerous other wagering games, including but not limited to Poker Dice, and Aces in the Pot may be configured for play and display on the display 115, and played over a local area computer network 401 or wide area computer network 501 of computer-controlled slot machines 101.

As used herein, the term "computer-controlled slot machine" denotes a computer controlled machine which facilitates wagering, which generally requires the input of money in order to be operated, and which outputs money in response to the achievement of winning wagering results.

Of course, the present invention is not limited to the generation and display of images in the form of the video simulated dice 541 illustrated in FIG. 5A, FIG. 5B, and FIG. 9. In other embodiments, other images are generated and displayed in the course of game play. For example, in one embodiment, the images generated and displayed are in the form of different colors. In another embodiment, graphical representations of different types of fruit are generated and displayed. In yet another embodiment, roman numerals are utilized. The generation and subsequent display of any image in a set of at least two display areas in the course of game play is within the scope of the present invention.

What is claimed is:

1. A method of playing a game on a computer controlled gaming machine having a display comprising:

displaying on the display a plurality of score areas pertaining to scoring categories, each scoring category corresponding to a particular target symbol;

presenting a turn of a game comprising:

displaying a set of symbols;

determining if a predetermined number of said symbols are the same;

if a predetermined number of said symbols are not the same, terminating the turn of the game; and if a predetermined number of said symbols are the same, designating that symbol the target symbol, displaying a replacement symbol for each of said displayed symbols not comprising the target symbol, generating a numerical score based upon the number of target symbols displayed, associating said score with said scoring category corresponding to the target symbol, and removing said target symbol from further play in said game;

presenting additional turns of said game until each of said scoring categories are filled; and determining the outcome of said game based upon the individual scores or total of said scores.

2. The method in accordance with claim 1 wherein said predetermined number of symbols comprises three.

3. The method in accordance with claim 1 wherein said set of displayed symbols comprises six symbols.

4. The method in accordance with claim 3 wherein each of said six symbols of said set of displayed symbols is selected from a sub-set of symbols.

5. The method in accordance with claim 1 wherein said set of symbols comprise representations of the sides of one or more dice.

6. The method in accordance with claim 1 including the step of accepting a wager before presenting said turn of said game.

7. The method in accordance with claim 1 wherein if a predetermined number of two different symbols displayed in said set of symbols are the same, accepting input assigning one of said symbols said target symbol.

8. A method of playing a dice game in which a player attempts to fill scoring categories, said game presented on a computer controlled gaming machine having a display, comprising:

presenting a turn of a game comprising:

accepting a wager;

displaying a set of dice symbols;

determining if a predetermined number of said dice symbols are the same;

if a predetermined number of said symbols are not the same, terminating said turn of said game;

if a predetermined number of said dice symbols are the same, designating that symbol a target symbol, displaying a replacement symbol for each displayed dice symbol that is not the target symbol up to two times, and generating a numerical score based upon the number of target symbols obtained;

associating said numerical score with a scoring category corresponding to the target symbol; and removing the target symbol from further use in the game; and permitting further turns of said game until all scoring categories have associated scores.

9. The method in accordance with claim 8 wherein six dice symbols are displayed in said set.

10. The method in accordance with claim 8 wherein said predetermined number of dice symbols comprises three.

11. The method in accordance with claim 8 wherein each of said displayed dice symbols is selected from a group of dice symbols representing all six sides of a standard die.

12. The method in accordance with claim 8 wherein said scoring categories corresponde to the target symbols comprising the sides of a die.

13. The method in accordance with claim 8 including the step of awarding winnings for each turn based upon the score received.

14. The method in accordance with claim 8 wherein said score is based upon a number of target symbols received in said turn.

15. The method in accordance with claim 14 wherein the numerical score for a number of target symbols received in a turn increases as target symbols are removed from play.

* * * * *

UNITED STATES PATENT AND TRADEMARK OFFICE

CERTIFICATE OF CORRECTION

PATENT NO. : 6,656,047 B1
DATED : December 2, 2003
INVENTOR(S) : Elia R. Tarantino and Eric J. Maiss It is certified that error appears in the above-identified patent and that said Letters Patent is hereby corrected as shown below:

Column 3,
Line 60, please delete "[119]".

Column 10,
Lines 51, 52 and 53, please delete "for example as illustrated in the Appendices A1 to A36 attached hereto and formed a part hereof".

Column 13,
Line 8, please delete "[high scores]".

Signed and Sealed this

Sixteenth Day of March, 2004

JON W. DUDAS
*Acting Director of the United States Patent and Trademark Office*